United States Patent [19]

Frohlich

[11] 4,261,569

[45] Apr. 14, 1981

[54] BASEBALL BOARD GAME

[76] Inventor: Stanley J. Frohlich, 1231 Denniston Ave., Pittsburgh, Pa. 15217

[21] Appl. No.: 57,844

[22] Filed: Jul. 16, 1979

[51] Int. Cl.[3] ..... A63F 7/06; A63F 3/00

[52] U.S. Cl. ..... 273/93 C; 273/93 R

[58] Field of Search ..... 273/93 R, 93 C, 244, 273/88

[56] References Cited

U.S. PATENT DOCUMENTS

| | | | |
|---|---|---|---|
| 367,991 | 8/1887 | McGill | 273/93 R |
| 950,810 | 3/1910 | Watterson | 273/93 R |
| 1,324,037 | 12/1919 | Tamble | 273/93 R |
| 1,536,639 | 5/1925 | Van Beek | 273/93 R |
| 1,550,692 | 8/1925 | Gorman | 273/93 R |
| 2,528,029 | 10/1950 | Brown | 273/93 R |
| 2,788,213 | 4/1957 | Hull | 273/93 C |
| 2,886,319 | 5/1959 | Henderson | 273/93 R |
| 3,224,773 | 12/1965 | Roed | 273/93 R |
| 3,428,317 | 2/1969 | Pulcifer | 273/93 R X |
| 3,528,661 | 9/1970 | Warner | 273/93 C |
| 3,649,017 | 3/1972 | Kirkpatrick | 273/93 R X |
| 3,734,501 | 5/1973 | Monica | 273/93 R |
| 3,817,524 | 6/1974 | Board | 273/93 R X |
| 3,819,185 | 6/1974 | Lowther | 273/143 E X |
| 3,957,269 | 5/1976 | Bouchard | 273/93 C |
| 3,972,530 | 8/1976 | Dohn | 273/93 R |

*Primary Examiner*—George J. Marlo

*Attorney, Agent, or Firm*—Buell, Blenko, Ziesenheim & Beck

[57] ABSTRACT

A baseball board game is disclosed which consists of a game board having a baseball diamond thereon; a random number generator preferably a pair of differently colored dice a first set of ballplayer cards including at least one pitcher and batters and having thereon a player identification, a list of possible random numbers and opposite each possible result a statement of a play event; and a second set of cards having thereon a symbol denoting a pitcher or batter and a list of possible locations of the lead baserunner and opposite each location a statement of a play event. Players choose their teams by selecting ballplayer cards. The action is controlled by generation of random numbers and looking to the cards to determine for the number generated the batter's performance and a baserunner's movement. The instructions on the cards are written so as to simulate the actual major league performance of the player whose name appears on it. Optional cards and rules are provided to make the game more complex and challenging.

12 Claims, 9 Drawing Figures

Fig. 2.

11

19

21

RUNNER REACTION (WITH BASES OCCUPIED)

(*REMEMBER: CONSULT RUNNER REACTION TABLE ONLY WHEN RUNNERS ARE ON BASE*)

| BAT-ACTION (*FROM FLASH*CARD*) | |
|---|---|
| SHORT SINGLE | – Batter reaches 1B. Runners advance 1 base. *[With 2 out, a DARING man on 2B scores.]* |
| SINGLE | – Batter reaches 1B. Runner on 1B moves to 2B. *[FAST or DARING runner takes 3B.]* Other runners score. |
| POP-FLY DOUBLE | – Batter reaches 2B. Runners advance 2 bases. *[With 2 out, runners advance 3 bases.]* |
| DOUBLE | – Batter reaches 2B. Runner on 1B is out at home. *[FAST or DARING man is safe.]* Other runners score. |
| BLOOP TRIPLE | – Batter is out at 3B (credit hitter with a DOUBLE only). All runners score. |
| TRIPLE | – Batter reaches 3B. Baserunners score. |
| deep fly out | – Batter is out. Runner on 3B scores. Other runners hold. *[FAST or DARING man on 2B takes 3B.]* |
| high fly out | – Batter is out. Runners hold base. CARELESS defence permits runners at 2B and 3B to advance 1 base. |
| line fly out | – Batter is out. Runners hold base. *[a DARING man scores from 3B.]* |
| infield lineout | – Batter is out. Trailing-runner is caught off base for a double play. Other runners must hold. |
| slow groundout | – Batter is out. Runners advance 1 base if forced from base. *[DARING man scores from 3B.]* |
| chop groundout | – Batter reaches 1B on fielder's choice. Head runner is out. Other runners advance 1 base. |
| hard groundout | – Batter is out. Runners advance 1 base. ALERT defense retires baserunner on 1B at 2B for a double play. |
| sharp groundout | – Batter is out. Double play if baserunner is on 1B. Head (most advanced) forced runner is out. Other runners advance 1 base. *[If 1B is vacant, men on 2B or 3B must hold base.]* |

NOTE: PITCH HITS BATTER *dice result advances runners 1 base, if forced from base. Batter is awarded 1B.*
WILD PITCH and PASSED BALL *events advance runners 1 base. Roll again for batter, since he remains at bat.*

13

14

17

23

Fig. 7.

70

TIME CHART 71

| Die Roll | ERA CHOICE | TIME SPAN | DOUBLE 4's EVENT |
|---|---|---|---|
| 72 1 | 73 DEADBALL | 74 1900 to 1919 | 76 PICK ERROR CARD |
| 2 | GOLDEN AGE | 1920 to 1939 | SINGLE |
| 3 | MODERN | 1940 to 1960 | WALK |
| 4 | EXPANSION | 1961 to present | STRIKEOUT |
| 5 | 21st CENTURY | 2001 + | HOMERUN |
| 6 | ETERNITY | 1900 to present | same as flash* card |

BASEBALL BOARD GAME

This invention relates to baseball board games for one or more players.

An object of this invention is to provide a table game which is a realistic and detailed simulation of the play occurring in major league baseball. This is accomplished through the use of a random number generator, like dice, and individual player-cards or charts which depict life-like seasonal performances of actual big league ballplayers.

A further object of this invention is to provide a realistic game which can be played in a brief time. Although there are numerous baseball games on the market, they take 30 minutes or longer to play. That is too long for many youngsters and unacceptable to many adults. The average playing time for this game is a much shorter, ten to fifteen minutes.

Another object of this invention is to provide a realistic game which can be played by both adults and children. Full-featured games are too complex for most youngsters and baseball games suitable for children are not challenging to adults. This game is easy enough for youngsters to play because it follows a simple format and the batter's result is spelled out in simple language on a ballplayer card. Optional features are included to make the game more complex and challenging.

A further object of this invention is to give players an opportunity to select and manage their team. Each player chooses his roster, selects his lineup, picks a starting pitcher, and decides when and who to substitute in the lineup or on the pitching mound. Selected ballplayers will perform statistically according to their real life records in the various areas of play such as hitting, pitching, running and fielding. Hence strategy in selecting a team is a key element of the game.

Another object of the invention is to provide a simple format without sacrificing realism. Prior art baseball table games that strive for realism have a multiplicity of charts, books, graphs and tables. This game on the other hand can be played with only a game board, markers, two sets of cards and a pair of dice.

Another object of the invention is to depict and contrast playing styles in different eras of baseball.

Other details, objects and advantages of the invention will become apparent as a present preferred embodiment of the invention proceeds.

In the accompanying drawings, I have shown a present preferred embodiment of the invention in which:

FIG. 2 is a plan view of the runner reaction card,

FIG. 7 is a plan view of the time chart used in an optional method of play.

THE EQUIPMENT

Figure 1:
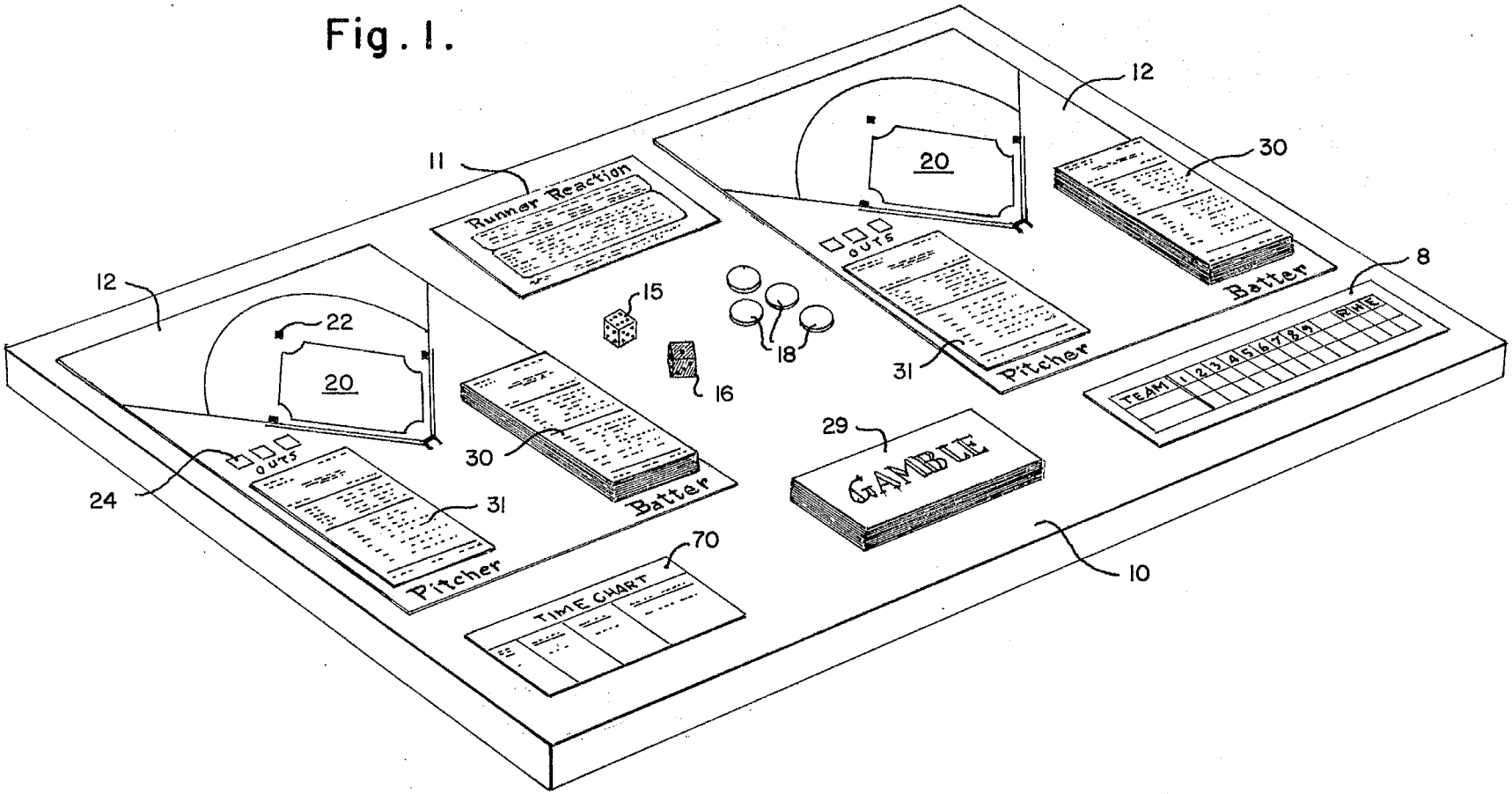
FIG. 1 is an isometric view of a table top layout of the game prior to play.

The basic equipment of the game are shown in FIG. 1 as they might be laid out on a table top 10 prior to play. Because baseball is a game played by two teams this game will normally be played by two players or two groups of players each representing a baseball team. For convenience two game boards 12 are provided thereby permitting each player or group of players to have his or their own game board. However, the game can easily be played using a single game board. A standard baseball diamond 20 is printed on the game board. The diamond should be large enough to enable markers 18 representing baserunners to be conveniently placed on the bases 22. Coins, chips or buttons as well as small figurines may be used as markers. Spaces 24 are also provided on which markers can be placed to keep track of outs. Space is provided on the game board 12 on which ballplayer cards 30 and 31 (See FIGS. 3 and 4) may be placed. A pair of dice 15 and 16 are used as a random number generator. The dice should be distinguishable from one another, by size color or other means. Here one die 15 is white and the other die 16 is colored. Spinners, number wheels and numbered balls drawn from a container as in bingo could also be used as random generators. A set of gamble cards 29 are also provided which are drawn when doubles are rolled. Only the back of the card is shown in FIG. 1; the faces of the cards are illustrated in FIGS. 5, 5A, 6 and 6A. A score sheet 8 is also provided for keeping score. A time chart 70 which lists various baseball eras is provided for use in an optional version of the game discussed below. A runner reaction card 11 is also provided for use in another optional version of the game.

In a preferred embodiment of the game the advancement of baserunners is determined by referring to a runner reaction chart 11 shown in FIG. 2. The chart contains a list of possible batting results 13 and opposite each result is a statement 14 of how the baserunners advance. Optional statements 17 used for advanced play are given in brackets. A title 19 is provided at the top of the chart under which a brief statement 21 appears indicating when to use the runner reaction chart. The results of play events which do not involve bat action are given in a note 23 at the bottom of the chart. While the use of the runner reaction chart makes the game more realistic, the game can be played without using the chart. If the runner reaction chart is not used runners will advance the same number of bases as the batter.

Figure 3:
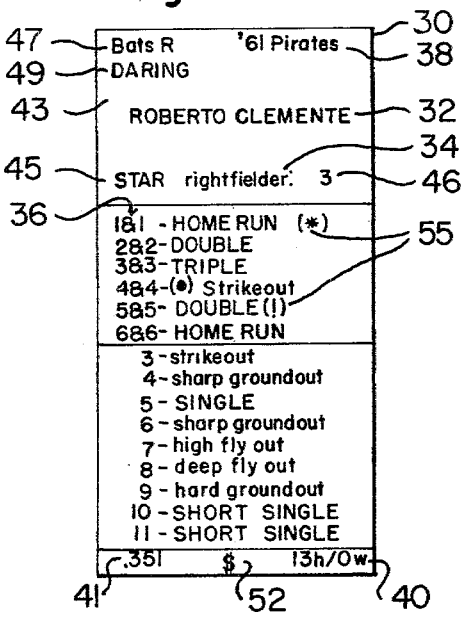
FIGS. 3 and 4 are the faces of ballplayer cards.
Figure 4:
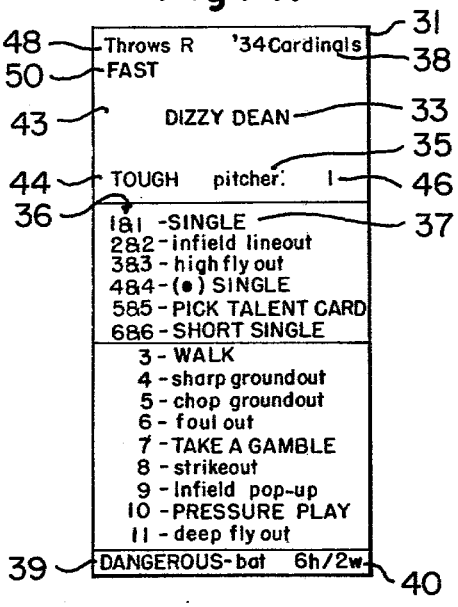

A set of ballplayer cards are also provided the faces of which are shown in FIGS. 3 and 4. Because the back of the card may be blank or have any desired design, it is not shown. On the face of each card 30 and 31 are printed the ballplayer's name 32 and 33, position 34 and 35 and a list 36 of possible results from the random number generator. Opposite each possible result is a statement of a play event 37. In the preferred embodiment of the game the play events stated are selected so that each player's performance in this game approximate's his actual major league activity in a particular year for a particular ballclub. A statement 38 of the selected year and ballclub appears in the upper right-hand corner of the ballplayer card 30 and 31. At the bottom right of the ballplayer card 30 is a ratio 40 of the number of dice combinations that trigger hits and the number of dice combinations that trigger walks. On Roberto Clemente's card 30, thirteen dice combinations trigger hits and no dice combination triggers a walk. Better hitters will have more hit and walk events on their cards. Hence, the ratio 40 provides a quick means of comparing ballplayers. For each nonpitcher ballplayer the individual's batting average 41 is also listed.

In the preferred embodiment of the invention, the play events listed on the ballplayer cards for pitchers are designed to reflect the pitcher's pitching ability rather than his batting ability. Hence, no batting average is listed on the ballplayer cards for pitchers. In place of the batting average a statement 39 of the pitcher's batting ability is listed. When it is time for the pitcher to bat a card similar to the nonpitcher ballplayer card is used. This card (not shown) is identical to the nonpitcher ballplayer card except in the player designation area 43 of the card. In that area 43 appears only a statement of the pitcher's batting ability such as "Dangerous-Bat" which corresponds to a statement 39 on the pitcher's card. A number of such cards, each with different hitting performances, are provided.

Figure 5:
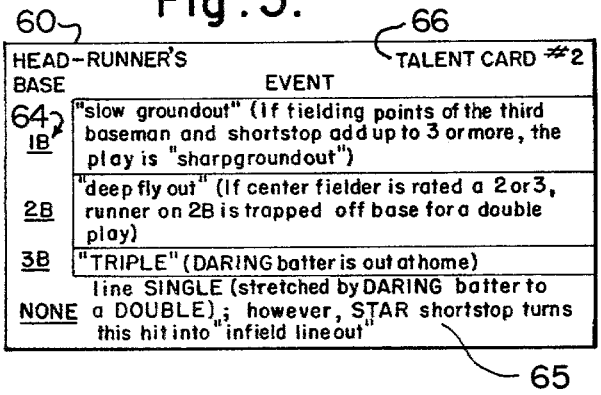
FIGS. 5 and 6 are the faces of gamble cards.
Figure 6:
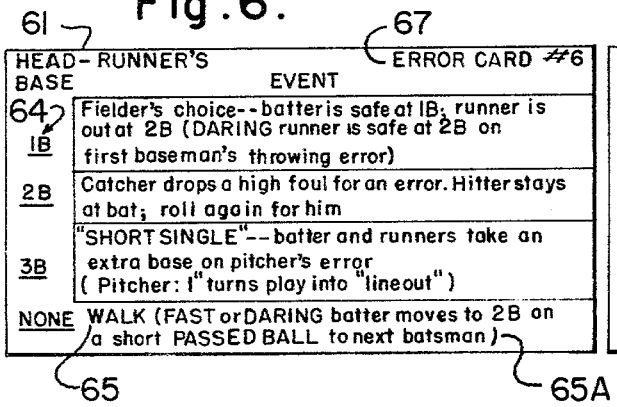

Each ballplayer card for a pitcher contains a statement 44 of his pitching ability which can be used to compare pitchers. Nonpitchers are given a verbal rating 45 of their fielding ability. In addition all ballplayers are assigned a numerical fielding ability rating. In the upper left of the ballplayer cards is an indication 47 and 48 revealing whether the player bats (nonpitchers) or pitches righthanded or lefthanded, and a notation 49 and 50 of his baserunning style. In some variations of the basic game these ratings are used to determine how baserunners advance. They may also be used to determine a batter's performance through additional rules of advanced play or optional instructions appearing in parentheses on the gamble cards (FIGS. 5 and 6). The relative value of the player is indicated by the presence or absence of one or more dollar signs 52 on the ballplayer card. This item can be used to select ballplayer cards for a game.

Symbols 55 are provided for selected play events. Under the rules for advanced play, a variation on the basic game, these symbols prompt the application of special rules for determining the play event. For example, in one variation of advanced play the play event HOMERUN becomes a BLOOP TRIPLE(!) but HOMERUN(*) remains unchanged. The symbol(!) tells the player to roll one die; if a 1, 3, or 6 are rolled a gust of wind blows the ball over the fence for a homerun. The instructions corresponding to each symbol are written to reflect chance events which occur in major league baseball.

Figure 5A:
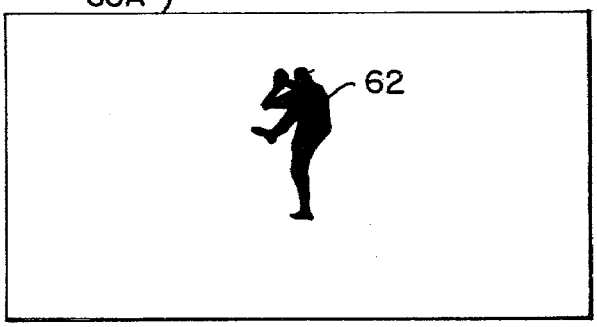
FIGS. 5A and 6A are plan views of silhouettes which are superimposed over the face of the gamble cards.
Figure 6A:
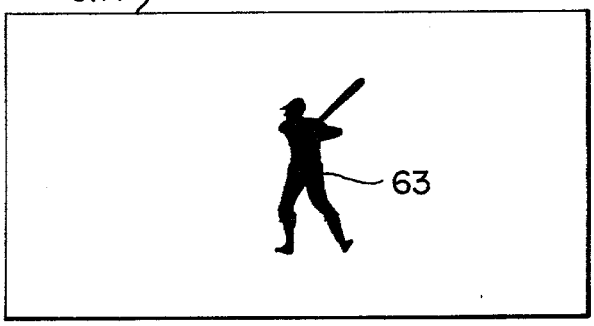

FIGS. 5, 5A, 6 and 6A show the face of the gamble cards. The back (shown in FIG. 1) contains the word "GAMBLE"and any desired design. On each card there appears a silhouette of a pitcher 62 or batter 63 which are superimposed over printing which appears on the card. For clarity the silhouettes are shown in FIGS. 5A and 6A separate from the printed matter shown in FIGS. 5 and 6. Printed on each card is a list 64 of possible positions for the furthest advanced baserunner. Opposite each possible position is a statement 65 of a play event. Statements of optional events 65A are enclosed in parentheses. These cards are further identified by statements 66 and 67 in their upper righthand corner as a Talent Card or Error Card.

FIG. 7 shows the Time Chart which is used in an optional version of the game called Time Travel. The chart 70 bears an appropriate title 71 and contains a list of die rolls 72. Opposite each roll is the name of a baseball era 73 and time span 74. Although I prefer to provide for the selection of the era of play by the random roll of a die, the players could agree to play in a particular era thereby avoiding the need for rolling a die. In Time Travel a roll of double fours always triggers an event 76 shown in the Time Chart. A particular event 76 is listed on the Time Chart for each era. The event is different for each era. Through the use of this Time Chart I provide a means for making some of the events entirely dependent on the era chosen for play.

PLAYING THE GAME

Although this game can be played by one player or a multiplicity of players divided into two groups, it is anticipated that usually only two people will play the game at any given time. Hence, for purposes of this discussion it will be assumed that there are only two players.

There are many variations which can be made in the game to make it more difficult and challenging. Because the rules for playing the basic game must be learned by all who wish to play the game those rules will be explained first. An explanation of possible variations in the basic play will follow after that.

To begin play, each player selects a team of nine ballplayers by choosing ballplayer cards for a first baseman, a second baseman, a short stop, a third baseman, left fielder, center fielder, a right fielder and a catcher and two cards, a Pitcher At Bat card and a ballplayer card, for his pitcher. Each player then arranges the cards representing each ballplayer in a batting order deck. The lead off hitter's card is placed on top, second batter underneath and so on. The Pitcher At Bat card is placed at the bottom of the lineup deck in the ninth batting position. The ballplayer card for the pitcher is kept separate from the deck. The players roll the dice to see who will have the home team. Then the player for the home team places his pitcher card on the game board in the space provided for the pitcher's card and his opponent places his batting order deck in the space provided on the game board for the batter card deck.

The game begins when the visiting team manager rolls the dice for his lead-off batter. The dice are distinguishable from one another by color, size, or other means. One die corresponds to the pitcher's card and the other to the batter's card. If the roll is not doubles, the player checks to see which die is higher. If the die corresponding to the pitcher's card is higher, the player reads the play event from the pitcher's card. If the die corresponding to the batter's card is higher, the player reads the play event from the batter's card.

Whenever the player rolls doubles, he chooses a gamble card, which carries the silhouette of either a pitcher or a batter. If the silhouette of a pitcher appears, the player looks at the pitcher's card and reads the play event corresponding to his doubles roll. If a batter silhouette appears, the player reads the play event from the batter's card. Whenever a gamble card is chosen in response to a doubles dice roll, rather than a play event, the printed instructions on the gamble card are disregarded. The roll of the dice is located on the appropriate card to determine the hitter's performance. If the hitter's card shows a hit the player places a marker representing a baserunner on the appropriate base and advances the other baserunners the same number of bases as the batter. If an out was made that performance is scored by placing a marker over the appropriate out space on the game board and baserunners will advance only if forced from a base. The manager completes each batter's turn by placing each hitter's card under the batting order deck uncovering the next batter's card as he does so. Thus, for each hitter's turn the visiting team manager continues to roll the dice until the home team comes to bat. A sheet of paper may be used to keep score.

Sometimes a dice roll reveals an instruction to "Take a Gamble", "Pick Error Card", "Pick Talent Card", "Extra Effort" and "Pressure Play". Whenever the instruction "Take a Gamble" or "Extra Effort" appears the player chooses a gamble card. Each gamble card describes four different events corresponding to the position of the furthest advance baserunner. The event which happens on that roll is the one listed for the position of the furthest advanced baserunner at that time in the game. If the instruction reads "Pick Error Card" or "Pick Talent Card" the player chooses gamble cards until selecting one having the corresponding identification "Error Card" "Talent Card" on its face, and reads the event listed for the position of the lead baserunner. If the instruction is "Pressure Play" the batter automatically strikes out. Whenever a gamble card is chosen in response to a play event instruction the silhouette on the card is disregarded.

The visiting team manager continues to roll until his team has made three outs thereby completing half an inning. Then his opponent comes to bat. The opponent or home team manager places his batting order deck on the board in place of the visiting team's deck. A similar change is made in the pitcher's card. Now the home team is at bat and play continues. If two boards are used as illustrated in FIG. 1, one board may be arranged to represent the visiting team at bat and the other set up for the home team at bat. The game ends after nine innings have been played.

The rules of the basic game can be supplemented and changed in many ways to make the game more challenging and to incorporate additional events which occur in major league baseball. Variations can be made in the rules for team selection, hitting, fielding and base running.

I provide a signing price for each ballplayer by placing a certain number of dollar sign symbols on the ballplayer's card. Each symbol represents a million dollars. Players whose cards have no symbol are considered "free". This symbol gives an indication of ballplayer's availability which can be used for a free-agent draft to choose a ballclub. Under this variation each player starts with a $9,000,000 budget. Then the players alternately select ballplayers whose combined value is within that budget. Other indicia of availability representing draft status, league association, or team commitment could also be applied to each ballplayer card for use in choosing ballplayers.

Prior to the game, players may choose an era in which to play. This selection can be made by agreement of the players or by the random roll of a die. A list of eras corresponding to each die roll is provided on the Time Chart (See FIG. 7). Once the era of play is determined the roll of double fours always triggers a particular result according to the era. Also, special rules may be added to further vary play in certain eras. For example, in the 21st CENTURY AND BEYOND era a special rule could provide that a designated hitter be used as a replacement batter for the pitcher.

Each player may be given the option of calling a particular batting play such as a bunt, sacrifice, suicide squeeze, or hit and run. A separate event card or chart similar to the ballplayer card can be provided for each type of batting play. When the player calls one of these plays, he rolls the dice and refers to the batting play card or chart rather than the pitcher's card or batter's card to determine what happens.

The fielding team may have the option of intentionally walking the batter. If an intentional walk is called the batter advances to first base and the next man in the lineup comes to bat.

Additional rules can be provided for the movement of baserunners. In a preferred embodiment of a game, I provide a runner reaction guide which indicates how runners advance for particular batting results. The chart (shown in FIG. 2) contains a list of some possible batting plays. Opposite each play is a statement which reports how the baserunners move. The statements are designed to simulate what occurs in major league baseball. I also provide a chart similar to the ballplayer cards which can be used when a player wishes his baserunner to steal a base. In order to make a steal, a player calls "Steal", rolls the dice, and reads the chart to determine the result.

Teams may be classified according to their fielding ability as being alert or careless. In the basic game the home team is always alert and the visiting team is always careless. The classification can be provided to reflect the individual fielding abilities of the individual players on the team. Each ballplayer is given a fielding score (See FIGS. 3 and 4, reference 46). The team with the highest fielding score is the alert team. Instructions are provided on the gamble cards to reflect individual fielding play and the runner reaction chart to reflect team fielding play. The instructions are such that the alert team will make more double plays.

Individual players may be independently classified as star fielders. A star fielder will make sensational plays as indicated on the gamble card (See FIG. 5). Another means of determining the fielding ability of each team is by reference to the classification of the pitcher's ability on the pitcher's card. Whenever a "Tough" pitcher is on the mound all his teammates are star fielders.

Pitcher fatique may be incorporated into the game by providing that a particular dice roll shall only be read on the batter's card. This rule would come into effect when the lead off hitter is up for his fifth turn at bat. Certain pitchers may be classified as "Workhorse" pitchers. If they are playing, the fatique rule will not come into effect as "Workhorse" pitchers never suffer fatique.

Another variation is to provide a shutout promotion by substituting a Pitcher At Bat card for the pitcher card if the pitcher has a shutout going at the beginning of the seventh inning. The hitting events are arranged on these cards to make it more difficult to get a hit after the substitution.

While I have shown and described a present preferred embodiment of the invention it is to be distinctly understood that the invention is not limited thereto but may be otherwise variously embodied within the scope of the following claims.

I claim:

1. A baseball game comprising:

a. a game board having drawn thereon a baseball field, b. a plurality of markers which can be used on the game board to represent baseball players, c. a random number generator, d. a first set of cards each representing a baseball player and including at least one pitcher and batters and having thereon (i) a player identification, (ii) a list of all possible results which can occur from the random number generator and (iii) opposite each possible result a statement of hitter's performance, e. a second set of gamble cards each of which has on its face (i) a symbol denoting one of a pitcher and a batter so that the second set denotes both pitcher and batter cards, (ii) indications of the possible locations of the furthest advanced baserunner and (iii) opposite each indication a statement of a play event.

2. The game of claim 1 wherein the player identification is selected from the group of player characteristics comprising a player's name, position, team, batting style, pitching style, baserunning style, relative fielding ability, and batting average.

3. The game of claim 1 wherein each card in the first set of cards contains thereon a symbol representing the availability of the ballplayer.

4. The game of claim 3 wherein the symbol represents signing price.

5. The game of claim 2 wherein those cards in the first set of cards bearing a position designation of pitcher are of a different color than the remaining cards in the first set.

6. The game of claim 2 also comprising a third set of cards each representing a pitcher at bat having thereon a list of all possible results which can occur from the random number generator, and opposite each possible result a statement of hitter's performance.

7. The game of claim 1 wherein the random number generator is a pair of dice each having the same dice indicia, but otherwise distinguishable one from the other.

8. The baseball game of claim 1 also comprising a second game board.

9. The game of claim 1 wherein a plurality of separate event cards are provided for use in place of said first set of cards having thereon a hitting play designation, a list of all possible random numbers, and opposite each possible number a statement of hitter's performance.

10. The game of claim 9 wherein the hitting designation is selected from the group of hitting plays comprising bunt, sacrifice, suicide squeeze, or hit and run.

11. The game of claim 1 also comprising a runner reaction chart which indicates how baserunner's advance for a particular hitting performance listed on the first set of cards.

12. The game of claim 1 also comprising a time chart having thereon a list of baseball eras and opposite each era a statement of a play event.

* * * * *

UNITED STATES PATENT AND TRADEMARK OFFICE

CERTIFICATE OF CORRECTION

PATENT NO. : 4,261,569

DATED : April 14, 1981

INVENTOR(S) : STANLEY J. FROHLICH

It is certified that error appears in the above–identified patent and that said Letters Patent are hereby corrected as shown below:

Column 2, line 17, after "random" insert --number--, same line, "generators" should read --generator--.

Column 6, line 17, "The" should read --This--.

Column 6, line 34, "fatique" should read --fatigue--.

Signed and Sealed this

*Seventh* Day of *July 1981*

[SEAL]

*Attest:*

RENE D. TEGTMEYER

*Attesting Officer*

*Acting Commissioner of Patents and Trademarks*